US006415120B1

(12) United States Patent
Tashiro et al.

(10) Patent No.: US 6,415,120 B1
(45) Date of Patent: Jul. 2, 2002

(54) CORONA DISCHARGING APPARATUS FOR USE IN ELECTROPHOTOGRAPHIC PRINTING APPARATUS

(75) Inventors: Hajime Tashiro; Manabu Suzuki; Tomio Sugaya; Yoshitaka Fujinuma, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/676,662

(22) Filed: Oct. 2, 2000

(30) Foreign Application Priority Data

Oct. 15, 1999 (JP) ..... 11-293111

(51) Int. Cl.[7] ..... G03G 15/02
(52) U.S. Cl. ..... 399/100; 399/115; 399/170
(58) Field of Search ..... 399/100, 115, 399/170, 171, 172

(56) References Cited

U.S. PATENT DOCUMENTS 4,864,363 A * 9/1989 Shinada ..... 399/100

* cited by examiner

*Primary Examiner*—Sophia S. Chen
*Assistant Examiner*—Hoang Ngo
(74) *Attorney, Agent, or Firm*—Sughrue Mion, PLLC

(57) ABSTRACT

In a corona discharging apparatus for use in an electrophotographic printing apparatus, a wire spring-like member having the torque limiter function is used for the cleaning member to conduct the power transmission of the screw shaft, and by releasing the load larger than a predetermined value, the deformation of the gear and deviation of the shaft are eliminated, and the lock of the motor is prevented from being generated.

1 Claim, 2 Drawing Sheets

CORONA DISCHARGING APPARATUS FOR USE IN ELECTROPHOTOGRAPHIC PRINTING APPARATUS

BACKGROUND OF THE INVENTION

1. Field of the Invention

The present invention relates to a cleaning mechanism of a corona discharging apparatus of an electrophotographic printing apparatus.

2. Description of the Related Art

In the corona discharging apparatus (charger) for use in the electrophotographing method, a method in which the high voltage is applied onto a tungsten wire onto which the predetermined tension is applied, and by the corona discharge generated thereby, the photoreceptor surface is charged, is used. The surface of the corona wire is coated by gold, platinum, or oxide film, however, by ozone generated by the corona discharge, the oxide such as $SiO_2$ is generated on the corona wire surface, or the toner scattering in the apparatus adheres to the surface. As described above, when the surface of the corona wire is stained by products or toner, because the corona discharge generated from the portion becomes uneven, thereby, unevenness (charge unevenness) is generated in the photoreceptor potential.

Recently, in a laser printer, an increase of minuteness and image quality is required, and the longitudinal streak caused by the charge unevenness is a fatal defect in the printing quality. Accordingly, conventionally, a corona wire cleaning mechanism by which cleaning of the corona wire is automatically conducted at the predetermined timing based on number of printing pages or the operating time, is well-known.

In the conventional method, a screw shaft is passed through a cleaning member in which a female-screw is tapped, and the screw shaft is rotated for a predetermined time by a small sized motor, thereby, the drive power in the axial direction is transmitted to the cleaning member. When the cleaning member is moved from an initial position of the motor to the opposite side, a wiper attached to the cleaning member cleans the corona wire. The cleaning member reversely rotates the screw shaft after a predetermined time, and operates the screw shaft so that the cleaning member returns to the initial position. The movement time of the cleaning member from the initial position to the opposite side differs because the load is changed according to the stained condition of the surface of the corona wire. There is a case where the cleaning member returns without arriving at the opposite side when the rotation time margin of the screw shaft is small. In such the case, because a portion that the cleaning of the corona wire is not conducted, is generated, it is forced to have the large rotation time margin of the screw shaft. However, because the screw shaft is rotated for a predetermined time, the rotation is continued also after the cleaning member reaches the turning point. Accordingly, the motor is continued to have a load thereon, therefore, by the deformation of a gear and deviation of the shaft, the gear is meshed-in and locked. Accordingly, when the load is light and the movement time to the opposite side is short, the locked time of the motor is long. When it comes to this condition, it is forced to replace the charger or transfer device by a unit, therefore, there is a problem that the maintenance requires a cost.

SUMMARY OF THE INVENTION

An object of the present invention is to prevent the generation of the lock by making the load applied on the motor smaller than a predetermined value by providing a torque limiter function to the cleaning member, and to make the cleaning member stably conduct the cleaning operation, and to improve the life of the corona discharging apparatus.

The above object can be attained, by releasing the load more than a predetermined value by using a wire spring-like member having the torque limiter function for a cleaning member to conduct the power transmission of the screw shaft, the deformation of the gear and the deviation of the shaft are eliminated, and, by preventing the generation of the lock of the motor.

DETAILED DESCRIPTION OF THE PREFERRED EMBODIMENTS

A description will be given in more detail of preferred embodiments of the invention with reference to the accompanying drawings.

Figure 1A:
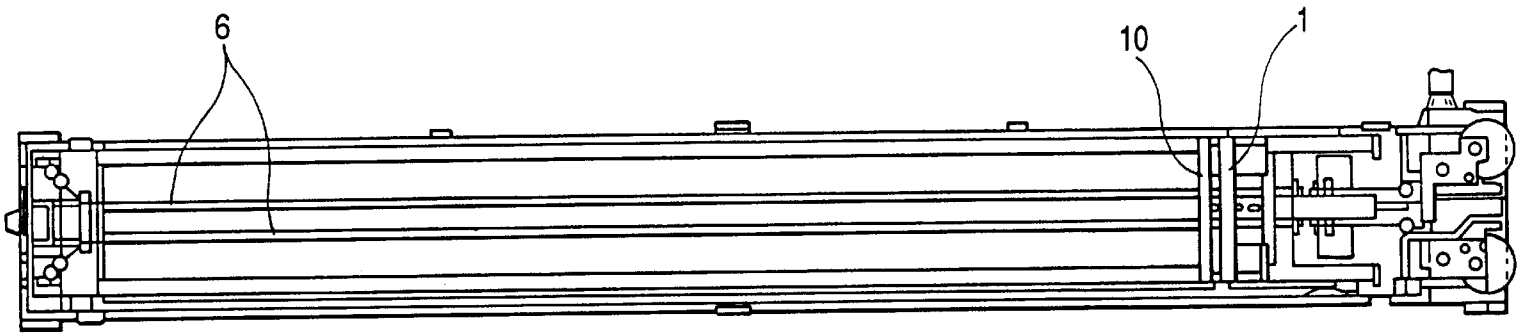
FIGS. 1A and 1B are structural views showing an example of a corona discharging apparatus of the present invention.
Figure 1B:
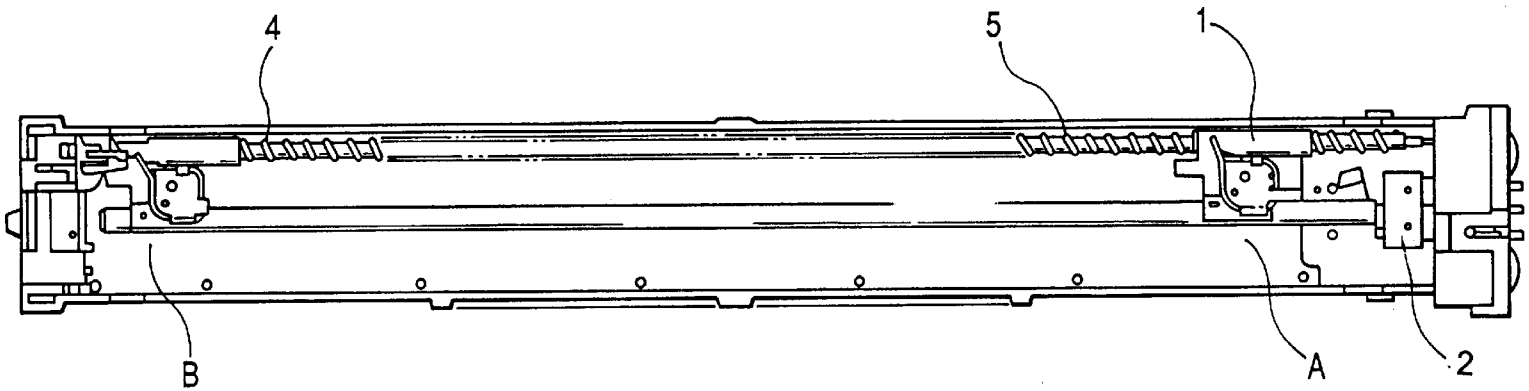
Figure 2:
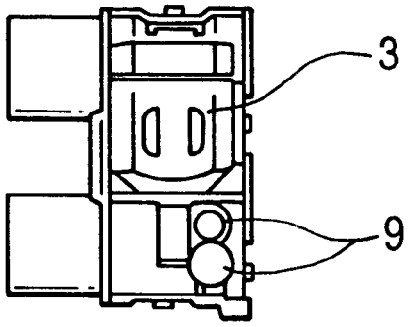
FIG. 2 is a right side view of a motor portion of the corona discharging apparatus of the present invention.
Figure 3:
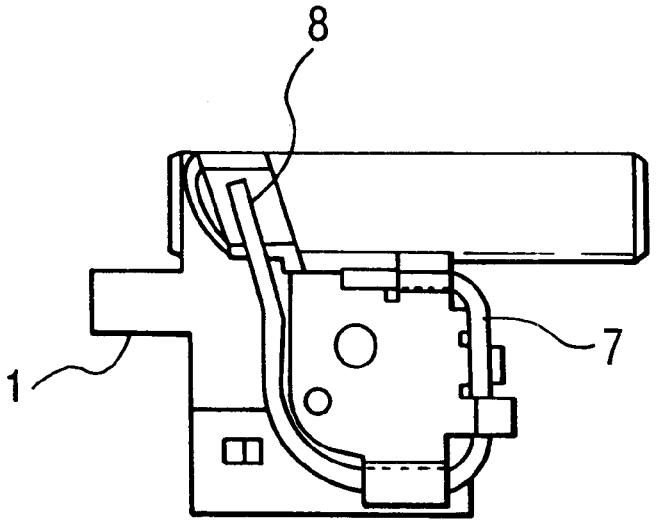
FIG. 3 is an enlarged view of a wire spring-like member of the corona discharging apparatus of the present invention.

FIG. 1A is a plan view in which the corona discharging apparatus of the present invention is viewed from the upside, and FIG. 1B is a view viewed from the lateral side. FIG. 2 and FIG. 3 are views showing the parts. In the printing operation condition or normal condition, a corona wire cleaning member 1 positions at one end (point A), and the position is sensed by a microswitch 2. At the timing when the power supply is turned on, and when the printing reaches a predetermined number of prints, for the cleaning of the corona wire 6, by the drive of a motor 3, the power is transmitted through a gear 9, and a screw shaft 5 starts the rotation. The cleaning member 1 which is in contact with the screw shaft 5 at an end 8 of a wire spring-like member 7 is moved from the start point of one end of the coil spring-like member 4 fixed side in the stretched direction of the corona wire 6, by the rotation of the coil spring-like member 4 of the screw shaft 5, when the coil spring-like member 4 pushes a wire spring-like member end 8. When the cleaning member 1 reaches the opposite side (point B) while cleaning the corona wire 6 by a wiper 10, because it can not move in the stretched direction further, the load larger than that in the movement is applied onto the cleaning member 1, and the wire spring-like member end portion 8 is separated, and while the rotation of the screw shaft 5 comes to the end, the member 1 continues to ride across the coil spring-like member 4. After a predetermined time, when the motor 3 starts the reversal rotation, in the same manner as in the foregoing, the coil spring-like member 4 pushes the wire spring-like member end portion 8, and the cleaning member 1 starts to move to the direction of the microswitch 2 of the start point. When the cleaning member 1 reaches the initial movement start point. When the cleaning member 1 reaches the initial movement start point (point A), the microswitch 2 senses it, and the rotation of the motor stops, and the rotation of the gear 9 and the screw shaft 5 ends. In the manner as described above, one cycle of the cleaning of the corona wire spring-like member 7, the deformation of the gear 9 and the deviation of the screw shaft 5 are eliminated, and the load applied on the motor 3 and the gear 9 is decreased to a volume smaller than a predetermined value, and the lock of the motor is prevented from being generated, thereby, the movement of the cleaning member 1 and the cleaning operation can be stably conducted with the passage of time.

As was described above, according to the present invention, excellent effects in which the load more than a predetermined value can be released, the deformation of the gear and the deviation of the shaft are eliminated, the generation of the lock of the motor is prevented, and the life of the corona discharging apparatus can be increased, can be obtained.

What is claimed is:

1. A corona discharging apparatus for use in an electrophotographic printing apparatus in which a voltage is applied onto a corona wire stretched in a shield case, and corona discharging is conducted, said corona discharging apparatus comprising:

a scorotron cleaning member;

a screw shaft having a screw-like shape to support said scorotron cleaning member and to move said cleaning member in a linear advancing movement by a rotational movement of said screw shaft;

a motor to drive said screw shaft; and a wire spring-like member as a transmission portion to convert the rotational movement of said screw shaft for moving said cleaning member to the linear advancing movement, wherein, in the transmission portion to convert the rotation of said screw shaft to the linear advancing movement, when a load more than a predetermined value is applied on said wire spring-like member from said screw shaft, said wire spring-like member is disconnected from a contact portion of a coil spring-like member of said screw shaft, so as not to transmit an excessive load thereby providing a torque limiting function.

* * * * *